US005724480A

United States Patent [19]

Yamaura

[11] Patent Number: 5,724,480

[45] Date of Patent: Mar. 3, 1998

[54] SPEECH CODING APPARATUS, SPEECH DECODING APPARATUS, SPEECH CODING AND DECODING METHOD AND A PHASE AMPLITUDE CHARACTERISTIC EXTRACTING APPARATUS FOR CARRYING OUT THE METHOD

[75] Inventor: Tadashi Yamaura, Kamakura, Japan

[73] Assignee: Mitsubishi Denki Kabushiki Kaisha, Tokyo, Japan

[21] Appl. No.: 548,448

[22] Filed: Oct. 26, 1995

[30] Foreign Application Priority Data

Oct. 28, 1994 [JP] Japan ..... 6-264832

[51] Int. Cl.[6] ..... G10L 3/02; G10L 9/00

[52] U.S. Cl. ..... 395/2.28; 395/2.29

[58] Field of Search ..... 395/2.28, 2.29, 395/2.3–2.32, 2.16, 2.17

[56] References Cited

U.S. PATENT DOCUMENTS

| | | | |
|---|---|---|---|
| 4,742,550 | 5/1988 | Fette | 395/2.29 |
| 4,850,022 | 7/1989 | Honda et al. | 395/2.29 |
| 4,932,061 | 6/1990 | Kroon et al. | 395/2.28 |
| 5,048,088 | 9/1991 | Taguchi | 395/2.29 |
| 5,067,158 | 11/1991 | Arjmand | 395/2.67 |
| 5,193,140 | 3/1993 | Minde | 395/2 |
| 5,293,448 | 3/1994 | Honda | 395/2.17 |

OTHER PUBLICATIONS

Schroeder & Atal "Code-excited linear prediction (CELP); High-quality speech at very low bit rates" ICASSP '85, pp. 937–940, 1985.

Moriya & Honda "Speech coder using phase equalization and vector quantization" ICASSP '86, pp. 1701–1704, 1986.

Kleijn, Krasinski & Ketchum "Improved Speech Quality and Efficient Vector Quantization in Selp" ICASSP '88, pp. 155–158, 1988.

Ikeda, Nakamura & Asada "Speech Coding Using All-pass Filter Response" Technical Reports of the Institute of Electronics, Information and Communication Engineers SP91-72, pp. 45–52, 1991.

Honda & Moriya "Speech Encoding Based on Phase Equalization" (Transactions of the Committee on speech Research, The Acoustical Society of Japan, S84–05, pp. 33–40, 1984.

*Primary Examiner*—Allen R. MacDonald
*Assistant Examiner*—Patrick N. Edouard
*Attorney, Agent, or Firm*—Wolf, Greenfield & Sacks, P.C.

[57] ABSTRACT

A speech coding and decoding apparatus for improving the quality of synthesized speech. A coding portion includes a filter for adding a short-term phase amplitude characteristic to an excitation signal, and a coding circuit for quantizing and coding a phase amplitude characteristic. A decoding portion includes a decoding circuit for decoding the coded phase amplitude characteristic, and a filter for adding the same phase amplitude characteristic as that in the coding portion. Thus, it is possible to synthesize high-quality speech with good reproducibility of the phase amplitude characteristic of an excitation signal.

8 Claims, 8 Drawing Sheets

SPEECH CODING APPARATUS, SPEECH DECODING APPARATUS, SPEECH CODING AND DECODING METHOD AND A PHASE AMPLITUDE CHARACTERISTIC EXTRACTING APPARATUS FOR CARRYING OUT THE METHOD

BACKGROUND OF THE INVENTION

1. Field of the Invention

The present invention relates to a code-excited linear prediction speech coding apparatus for compressing and coding a speech signal into a digital signal, a code driving linear prediction speech decoding apparatus for decoding the compressed signal, a speech coding and decoding method and a phase amplitude characteristic extracting apparatus which is available for this method.

2. Description of the Prior Art

FIG. 7 shows the overall structure of an example of a conventional code-excited linear prediction speech coding and decoding apparatus which is shown in "Improved Speech Quality and Efficient Vector Quantization in SELP" by W. B. Kleijn, D. J. Krasinski, R. H. Ketchrum (ICASSP 88, pp. 155 to 158, 1988).

This apparatus includes a coding portion 1, a decoding portion 2, a multiplexing means 3 and a separating means 4. Input speech 5 is input to these elements and output therefrom as output speech 6. This apparatus further includes a linear prediction parameter analysis means 7, a linear prediction parameter coding means 8, and synthesis filters 9, 18. Adaptive codebooks 10, 14, random codebooks 11, 15, and an optimum code searching means 12 constitute an excitation signal generating means. The gains of codevectors are coded by an excitation gain coding means 13. The decoding portion 2 includes an excitation gain decoding means 16 and a linear prediction parameter decoding means 17.

The operation of the conventional code-excited linear prediction speech coding and decoding apparatus will now be explained.

In the coding portion 1, the linear prediction parameter analysis means 7 first extracts a linear prediction parameter by analyzing the input speech 5. The linear prediction parameter coding means 8 then quantizes the linear prediction parameter, and outputs the code corresponding to the parameter to the multiplexing means 3 and the quantized linear prediction parameter to the synthesis filter 9.

The adaptive codebook 10 stores excitation signals which have been obtained and outputs an adaptive vector which corresponds to an adaptive code L input from the optimum code searching means 12. The random codebook 11 stores N random vectors which are produced from random noise, for example, and outputs a random vector which corresponds to a random code I input from the optimum code searching means 12. The synthesis filter 9 generates synthesized speech by using the quantized linear prediction parameter and an excitation signal which is obtained by adding the adaptive vector and the random vector which are multiplied by excitation gains $\beta$ and $\gamma$, respectively.

The optimum code searching means 12 evaluates the perceptual weighted distortion constituting a residual signal between the synthesized speech and the input speech 5, obtains the adaptive code L, the random code I and the excitation gains $\beta$ and $\gamma$ which minimize the distortion, and outputs the adaptive code L and the random code I to the multiplexing means 3 and the excitation gains $\beta$ and $\gamma$ to the excitation gain coding means 13. The excitation gain coding means 13 quantizes the excitation gains $\beta$ and $\gamma$ and outputs those codes to the multiplexing means 3.

The adaptive codebook 10 updates the contents of the codebook 10 by using the excitation signal generated by using the adaptive vector corresponding to the adaptive code L, the random vector corresponding to the random code I and the quantized excitation gains $\beta$ and $\gamma$ which minimize the distortion.

As a result of the above-described operation, the multiplexing means 3 supplies the code which corresponds to the quantized linear prediction parameter, and the codes which correspond to the adaptive code L, the random code I and the excitation gains $\gamma$ and $\beta$ to a transmission path.

The operation of the decoding portion 2 will now be explained.

The separating means 4 which receives the outputs from the multiplexing means 3 separates the outputs and transmits the supplied adaptive code L to the adaptive codebook 14, the random code I to the random codebook 15, the codes of the excitation gains $\gamma$ and $\beta$ to the excitation gain decoding means 16, and the code of the linear prediction parameter to the linear prediction parameter decoding means 17.

The adaptive codebook 14 outputs the adaptive vector which corresponds to the adaptive code L, and the random codebook 15 outputs the random vector which corresponds to the random code I. The excitation gain decoding means 16 decodes the excitation gains $\beta$ and $\gamma$ and as to multiply the adaptive vector by the gain $\beta$ and the random vector by the gain $\gamma$.

The linear prediction parameter decoding means 17 decodes the linear prediction parameter which corresponds to the code of the linear prediction parameter and outputs the decoded linear prediction parameter to the synthesis filter 18. The synthesis filter 18 synthesizes an excitation signal which is obtained by adding the adaptive vector and the random vector by using the linear prediction parameter, and outputs the output speech 6.

The adaptive codebook 14 updates the contents of the codebook by using the excitation signal in the same way as the adaptive codebook 10 of the coding portion 1.

Another coding and decoding apparatus is shown in FIG. 8.

FIG. 8 shows an apparatus having coding and decoding means for coding and decoding the phase characteristic of an excitation signal which is shown in "Speech Coding Using All-pass Filter Response" by Ikeda, Nakamura and Asada (Technical Reports of the Institute of Electronics, Information and Communication Engineers SP 91–72, pp. 45 to 52, 1991). The structure of this apparatus is different from that of the apparatus shown in FIG. 7 in that the former further includes pulse train generating means 19, 25, phase characteristic codebooks 20, 26, phase characteristic adding filters 21, 27, an optimum excitation.phase characteristic searching means 22, a pulse position coding means 23 and a pulse position decoding means 24.

In the coding portion 1, the pulse train generating means 19 outputs a pulse train which corresponds to the position of the head pulse and the pulse interval which are input from the optimum excitation.phase characteristic searching means 22. The phase characteristic adding filter 21 is, for example, an N-order all-pass filter whose transfer function H(z) is represented by the following formula (1):

$$H(z)=\frac{\sum_{k=0}^{N} a(k)z^{-(N-k)}}{\sum_{k=0}^{N} a(k)\,z^{-k}} \quad (1)$$

The phase characteristic codebook 20 stores a plurality of filter coefficients which are created on the assumption that the impulse response of the phase characteristic adding filter 21, for example, is given as a random sequence of numbers, and outputs the filter coefficient which corresponds to the code input from the optimum excitation.phase characteristic searching means 22 to the phase characteristic adding filter 21. The phase characteristic adding filter 21 adds a phase characteristic by using the filter coefficient to the excitation signal which is obtained by multiplying the pulse train output from the pulse train generating means 19 by an excitation gain g mission, by using the filter coefficient, and outputs the phase characteristic added excitation signal to the synthesis filter 9. The synthesis filter 9 generates synthesized speech by using the quantized linear prediction parameter which is input from the linear prediction parameter coding means 8 and the excitation signal to which the phase characteristic is added.

The optimum excitation.phase characteristic searching means 22 obtains the position of the head pulse and the pulse interval of the pulse train, the excitation gain g and the code of the phase characteristic which minimize the perceptual weighted distortion of a residual signal between the synthesis speech and the input speech 5, and outputs the position of the head pulse and the pulse interval of the pulse train to the pulse position coding means 23, the excitation gain g to the excitation gain coding means 13, and the code of the phase characteristic to the multiplexing means 3.

The pulse position coding means 23 quantizes the position of the head pulse and the pulse interval of the pulse train and outputs the codes to the multiplexing means 3.

The multiplexing means 3 which has received these codes transfers the code which corresponds to the linear prediction parameter, the code of the phase characteristic, the codes which correspond to the quantized position of the head pulse and the pulse interval of the pulse train, and the code corresponding to the quantized excitation gain g to the separating means 4.

The operation of the decoding portion 2 will now be explained.

The separating means 4 which has received the outputs of the multiplexing means 3 outputs the codes which correspond to the quantized position of the head pulse and the pulse interval of the pulse train to the pulse position decoding means 24, the code of the excitation gain g to the phase characteristic codebook 28, and the code of the linear prediction parameter to the linear prediction parameter decoding means 17.

The pulse position decoding means 24 decodes the position of the head pulse and the pulse interval which correspond to the codes of the position of the head pulse and the pulse interval of the pulse train and outputs the decoded position and pulse interval to the pulse train generating means 25. The pulse train generating means 25 outputs the pulse train which corresponds to the position of the head pulse and the pulse interval to the phase characteristic adding filter 27.

The excitation gain decoding means 18 decodes the excitation gain g which corresponds to the code of the excitation gain. The phase characteristic codebook outputs the filter coefficient which corresponds to the code of the phase characteristic to the phase characteristic adding filter 27.

The phase characteristic adding filter 27 adds the phase characteristic to the excitation signal which is obtained by multiplying the pulse train by the excitation gain g, by using the filter coefficient, and outputs the excitation signal obtained to the synthesis filter 1B. The synthesis filter 18 outputs the output speech 6 by using the linear prediction parameter which is input from the linear prediction decoding means 17 and the excitation signal with the phase characteristic added thereto.

A conventional apparatus for obtaining the short-term phase amplitude characteristic of the linear prediction residual signal of speech is shown in FIG. 9. This is an apparatus described in "Speech Encoding Based on Phase Equalization" by Honda and Morlya (Transactions of the Committee on Speech Research The Acoustical Society of Japan S84–05, pp. 33 to 40, 1984).

In FIG. 9, speech is input as input speech 101, and a phase amplitude characteristic 102 is obtained. This apparatus includes a linear prediction parameter analysis means 103, a linear predictive inverse filter 104, a pitch extracting means 105, a pitch position extracting means 106, and a phase amplitude characteristic adding filter coefficient calculator 107.

The process for obtaining the short-term phase amplitude characteristic of the linear prediction residual signal of speech will be explained.

When the input speech 101 is input, the linear prediction parameter analysis means 103 analyzes the input speech 101 so as to extract the linear prediction parameter and outputs the extracted linear prediction parameter to the linear predictive inverse filter 104. The linear predictive inverse filter 104 generates a linear prediction residual signal from the input speech 101 by using the linear prediction parameter, and outputs the linear prediction residual signal to the pitch position extracting means 106 and the phase amplitude characteristic adding filter coefficient calculator 107.

The pitch extracting means 105 extracts the pitch period of the input speech 101 by a known method and outputs the extracted pitch period to the pitch position extracting means 106. The pitch position extracting means 106 extracts the pitch position at every pitch period as the position at which the linear prediction residual signal has the maximum amplitude in one pitch period, and outputs the pitch position to the phase amplitude characteristic adding filter coefficient calculator 107.

The phase amplitude characteristic adding filter coefficient calculator 107 obtains the function of a phase amplitude characteristic adding filter (FIG. 10) having an impulse response which outputs the linear prediction residual signal when a pulse train, in which pulses exist only at pitch positions, is input, and outputs the function as the phase amplitude characteristic 102. The phase amplitude characteristic adding filter is, for example, an N-order filter whose transfer function H(z) is represented by the following formula (2).

$$H(z)=\sum_{k=0}^{N} a(k)z^{-k} \quad (2)$$

Alternatively, the phase amplitude characteristic adding filter may be, for example, an N-order all-pass filter whose transfer function H(z) is represented by the formula (1).

The above-described prior art has the following problems.

Speech is composed of voiced speech and unvoiced speech. The reproducibility of voiced speech exerts a great influence on the quality of synthesized speech. It is possible to model the excitation of a voiced sound in the form of a signal having a pitch periodicity and a short-term phase characteristic in the pitch periodicity.

In the conventional code-excited linear prediction speech coding apparatus, the excitation signal is represented by the sum of an adaptive vector and a random vector. This method does not directly represent the phase characteristic of the excitation signal. Therefore, there is a case in which the phase characteristic of the excitation signal is not reproduced, which leads to a deterioration of the quality of synthesized speech.

This problem is serious, for example, at a transitional portion from unvoiced speech to voiced speech or at a voiced speech where the pitch period changes greatly. At such a portion, an adaptive vector does not adequately work so that it is necessary to reproduce the pitch period and the phase characteristic using only the random vector.

In the conventional coding and decoding apparatus for coding the phase characteristic of an excitation signal, although the phase characteristic of an excitation signal is coded, since an excitation signal is assumed to have a simple pulse train, when an appropriate phase characteristic is not found in the phase characteristic codebook, it is impossible to complete the phase characteristic using an excitation signal, which leads to a deterioration of the quality of synthesized speech.

In the case of adopting the conventional method of obtaining the short-term phase amplitude characteristic of the linear prediction residual signal of speech, although it is necessary to obtain the pitch period and the pitch position, since it is not always possible to obtain the exact pitch period and pitch position, the difference between the phase amplitude characteristic obtained from the inexact pitch period and pitch position and that obtained from the exact ones will increase according to the degree of the error.

SUMMARY OF THE INVENTION

Accordingly, it is an object of the present invention to eliminate the above-described problems in the prior art and to provide a code-excited linear prediction speech coding and decoding apparatus and a speech coding and decoding method which can avoid a deterioration in the quality of synthesized speech and generate synthesized speech having a good quality.

To achieve this end, in a first aspect of the present invention there is provided a speech coding apparatus comprising: a linear prediction parameter analysis means; a linear prediction parameter coding means; an excitation signal generating means; a synthesis filter for synthesizing the output signal of the linear prediction parameter coding means and the excitation signal output from the excitation signal generating means; a phase amplitude characteristic coding means for quantizing and coding the phase amplitude characteristic which is obtained by analyzing the linear prediction residual signal of an input speech signal; and a phase amplitude characteristic adding filter for adding a short-term phase amplitude characteristic to the excitation signal.

According to this structure, the short-term phase amplitude characteristic of an excitation signal is quantized and coded, so that the phase amplitude characteristic is positively added to the excitation signal. As a result, it is possible to synthesize speech of a high quality with a good reproducibility of the phase characteristic of the excitation signal.

In a second aspect of the present invention, there is provided a speech decoding apparatus comprising: a linear prediction parameter decoding means; an excitation signal generating means; a synthesis filter for synthesizing the output signal of the linear prediction parameter decoding means and the excitation signal output from the excitation signal generating means; a phase amplitude characteristic decoding means for decoding a coded short-term phase amplitude characteristic; and a phase amplitude characteristic adding filter for adding the decoded phase amplitude characteristic to the excitation signal.

According to this structure, the coded short-term phase amplitude characteristic is decoded, and the phase amplitude characteristic is positively added to the excitation signal. As a result, it is possible to synthesize speech of a high quality with a good reproducibility of the phase characteristic of the excitation signal.

In a third aspect of the present invention, there is provided a speech coding and decoding method comprising a coding process and a decoding process:

the coding process including the steps of: coding a linear prediction parameter by the linear prediction analysis of an input speech signal; selecting a codevector for generating optimum synthesized speech from an adaptive codebook and a random codebook; and coding and transmitting the excitation signal; and the decoding process including the steps of: generating an excitation signal and a decoded linear prediction parameter signal on the basis of the received signal; and synthesizing the excitation signal and the decoded linear prediction parameter signal by a synthesis filter so as to generate an output speech signal. The coding process further includes the steps of: quantizing and coding the phase amplitude characteristic which is obtained by analyzing the linear prediction residual signal of an input speech signal; and adding a short-term phase amplitude characteristic to the excitation signal, and the decoding process further includes the steps of: decoding the coded phase amplitude characteristic; and adding the decoded phase amplitude characteristic to the excitation signal so as to generate the output speech signal.

According to this structure, the short-term phase amplitude characteristic of an excitation signal is quantized in the coding process, and the coded phase amplitude characteristic is decoded in the decoding process, so that the phase amplitude characteristic is positively added to the excitation signal. As a result, it is possible to transmit speech of a high quality with a good reproducibility of the phase characteristic of the excitation signal.

In a fourth aspect of the present invention, there is provided a phase amplitude characteristic extracting apparatus for extracting the short-term phase amplitude characteristic of a signal, comprising: a phase amplitude characteristic codebook which stores a plurality of short-term phase amplitude characteristics of signals; a phase amplitude characteristic removing filter for removing a phase amplitude characteristic; a residual signal generating means for generating a residual signal by removing the phase amplitude characteristic stored in the phase amplitude characteristic codebook from the input signal the phase amplitude characteristic removing filter; a pulse approximate means or a pulse signal representation means for generating a pulse approximated signal or a pulse signal representation signal by reducing the residual signal to a small number of pulses; a trial signal generating means for generating a trial signal by adding each removed phase amplitude characteristic to the pulse approximated signal; and a selecting and outputting means for selecting the phase amplitude characteristic which minimizes the distortion between the trial signal and the input signal, from the phase amplitude characteristic codebook and outputting the selected phase amplitude characteristic.

According to this structure, a residual signal is obtained by removing each of the phase amplitude characteristics stored in the phase amplitude characteristic codebook from an input signal by inverse filters, and each residual signal is reduced to a small number of pulses. Each of the removed phase amplitude characteristics is added to the approximate signal, and the phase amplitude characteristic which minimizes the distortion between this signal and the input signal is selected from the codebook. In this way, the short-term phase amplitude characteristic of the signal is obtained. As a result, for example, when the short-term phase amplitude characteristic of the linear prediction residual signal of a speech is obtained, it is not necessary to extract the pitch period and the pitch position, thereby preventing an error in the extraction of the phase amplitude characteristic.

The above and other objects, features and advantages of the present invention will become clear from the following description of the preferred embodiments thereof, taken in conjunction with the accompanying drawings.

DESCRIPTION OF THE PREFERRED EMBODIMENTS

First Embodiment

A speech coding and decoding apparatus according to the present invention will be explained with reference to the accompanying drawings.

Figure 1:
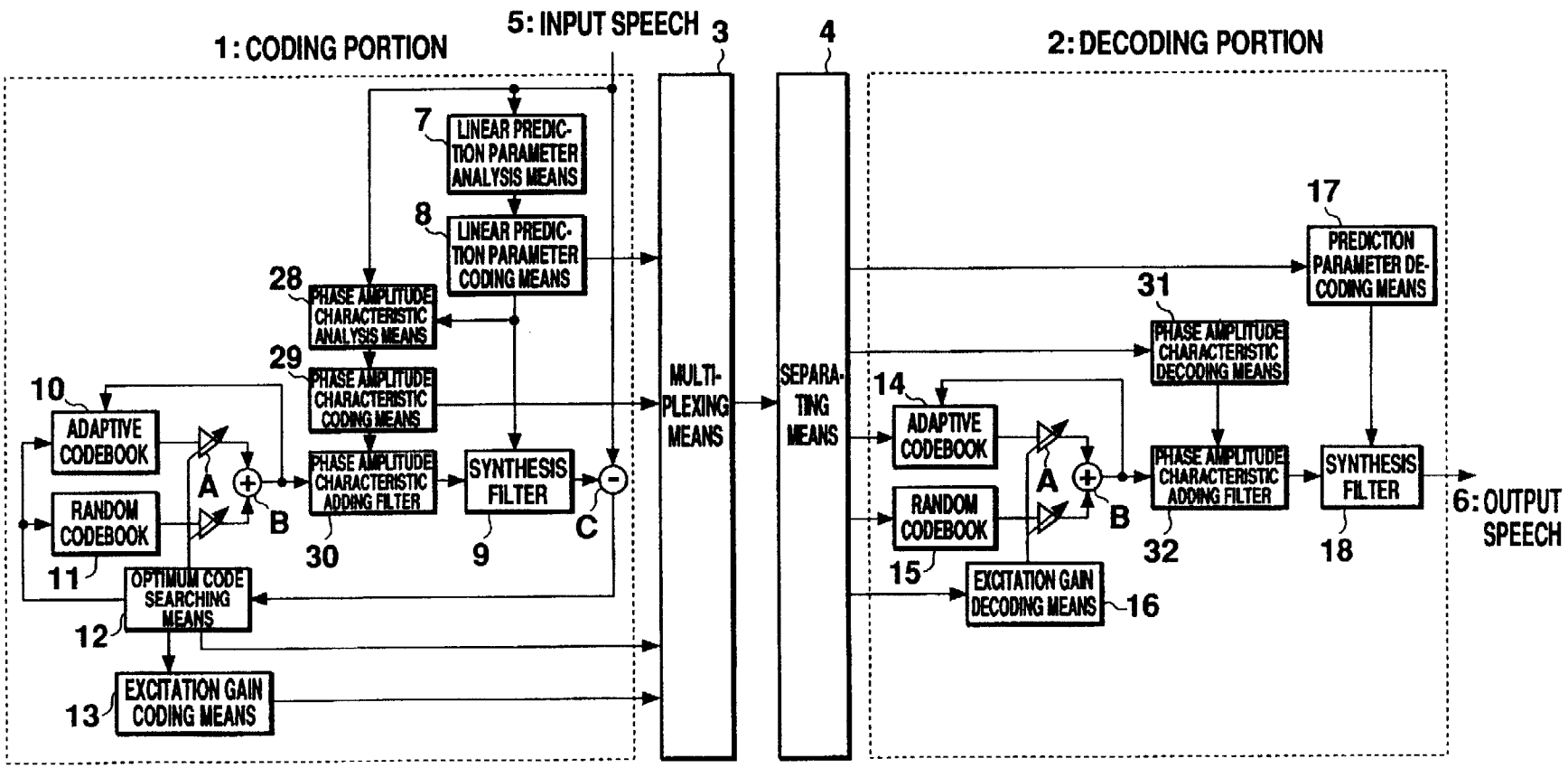
FIG. 1 is a block diagram of the overall structure of a first embodiment of the present invention.
Figure 7:
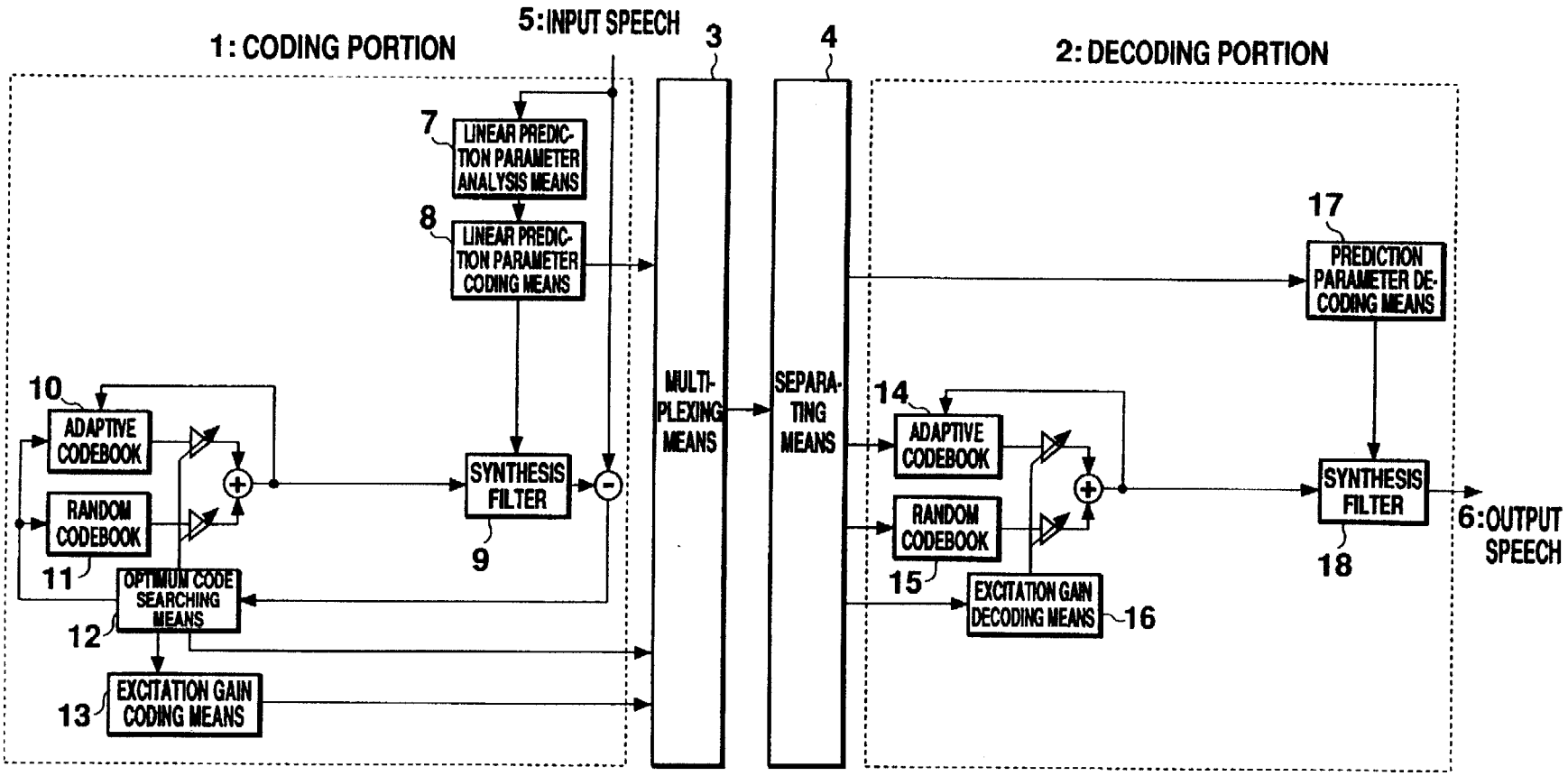
Fig. 7 PRIOR ART
FIG. 7 is a block diagram of the overall structure of an example of a conventional code-excited linear prediction speech coding and decoding apparatus.

FIG. 1 is a block diagram of a first embodiment of a speech coding and decoding apparatus according to the present invention. The same elements as those shown in FIG. 7 are provided with the same reference numerals and explanation thereof will be omitted.

This embodiment is characterized by the following newly added elements: phase amplitude characteristic analysis means 28 for analyzing a phase amplitude characteristic, phase amplitude characteristic coding means 29 for coding a phase amplitude characteristic, phase amplitude characteristic adding filters 80, 32 for adding a phase amplitude characteristic, and phase amplitude characteristic decoding means 31 for decoding phase amplitude characteristic.

In the coding portion 1, the phase amplitude characteristic analysis means 28 generates a linear prediction residual signal by using the input speech 5 and the linear prediction parameter which is input from the linear prediction parameter coding means 8, obtains the short-term phase amplitude characteristic of the linear prediction residual signal as a filter coefficient by using, for example, a conventional method of obtaining the short-term phase amplitude characteristic of a linear prediction residual signal of speech, and outputs the filter coefficient to the phase amplitude characteristic coding means 29. The phase amplitude characteristic coding means 29 quantizes the filter coefficient and outputs the corresponding code to the multiplexing means 3, and the quantized filter coefficient to the phase amplitude characteristic adding filter 30.

The phase amplitude characteristic adding filter 30 adds the phase amplitude characteristic by using the quantized filter coefficient to the excitation signal which is obtained by multiplying the adaptive vector which is output from the adaptive codebook 10 by the excitation gain $\beta$ and multiplying the random vector which is output from the random codebook 11 by the excitation gain $\gamma$, and adding the products, and outputs the thus-obtained excitation signal to the synthesis filter 9. The synthesis filter 9 generates synthesized speech by using the quantized linear prediction parameter which is input from the linear prediction parameter coding means 8 and the excitation signal with the phase amplitude characteristic added thereto.

The optimum code searching means 12 evaluates the perceptual weighted distortion of a residual signal between the synthesized speech and the input speech 5, obtains the adaptive code L, the random code I and the excitation gains $\beta$ and $\gamma$ which minimize the distortion, and outputs the adaptive code L and the random code I to the multiplexing means 3 and the excitation gains $\beta$ and $\gamma$ to the excitation gain coding means 13. The excitation gain coding means 13 quantizes the excitation gains $\beta$ and $\gamma$ and outputs those codes to the multiplexing means 3.

On the basis of these results, the multiplexing means 3 supplies the code which corresponds to the quantized linear prediction parameter, the code which corresponds to the quantized filter coefficient of the phase amplitude characteristic adding filter 30, and the codes which correspond to the adaptive code L, the random code I and the excitation gains $\beta$ and $\gamma$ to a transmission path.

The above-described operation is characteristic of the coding portion 1 of a speech coding and decoding apparatus of this embodiment.

The operation of the decoding portion 2 will now be explained.

The separating means 4 which receives the outputs from the multiplexing means 3 separates the outputs and transmits the supplied adaptive code L to the adaptive codebook 14, the random code I to the random codebook 15, the codes of the excitation gains $\beta$ and $\gamma$ to the excitation gain decoding means 18, the code of the filter coefficient of the phase amplitude characteristic adding filter 30 to the phase amplitude characteristic decoding means 31, and the code of the linear prediction parameter to the linear prediction parameter decoding means 17.

The phase amplitude characteristic decoding means 31 decodes the filter coefficient which corresponds to the code of the filter coefficient of the phase amplitude characteristic adding filters 30 and outputs the decoded filter coefficient to the phase amplitude characteristic adding filter 32.

The phase amplitude characteristic adding filter 32 adds the phase amplitude characteristic obtained using decoded quantized filter coefficient to the excitation signal which is obtained by multiplying the adaptive vector which is output from the adaptive codebook 14 by the excitation gain β output from the excitation gain decoding means 18 and multiplying the random vector which is output from the random codebook 15 by the excitation gain γ output from the excitation gain decoding means 18, and adding the products, and outputs the thus-obtained excitation signal to the synthesis filter 18. The synthesis filter 18 generates synthesized speech by using the linear prediction parameter which is input from the linear prediction parameter decoding means 17 and the excitation signal with the phase amplitude characteristic added thereto, and outputs the synthesized speech.

The above-described operation is characteristic of the decoding portion 2 of a speech coding and decoding apparatus of this embodiment.

According to this embodiment, it is possible to enhance the reproducibility of an excitation signal and to improve the quality of synthesized speech by coding the short-term phase amplitude characteristic of a linear prediction residual signal and addling it to the excitation signal.

Second Embodiment

Another embodiment of a speech coding and decoding apparatus according to the present invention will be explained with reference to the accompanying drawings.

Figure 2:
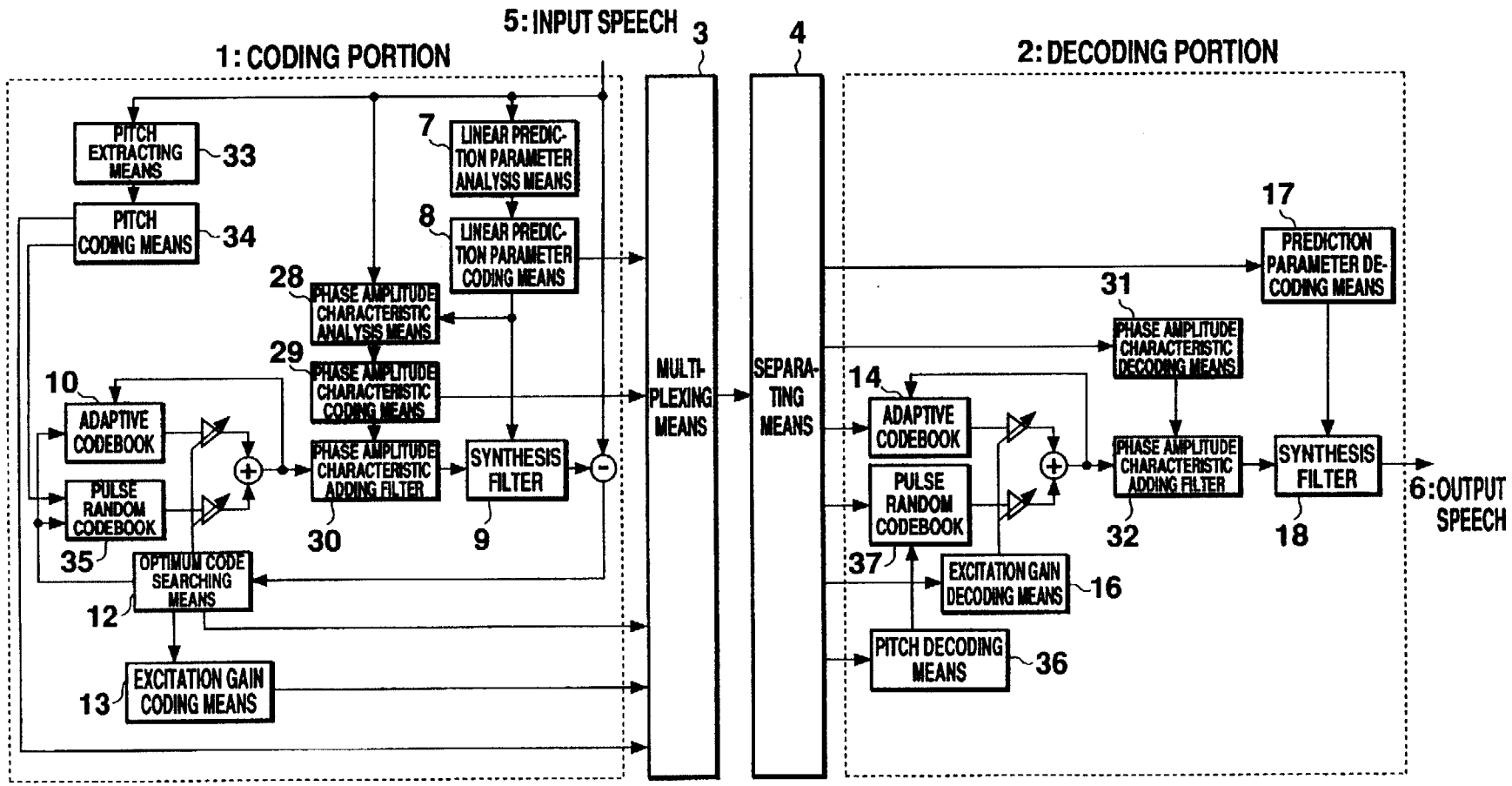
FIG. 2 is a block diagram of the overall structure of a second embodiment of the present invention.

FIG. 2 is a block diagram of a second embodiment of a speech coding and decoding apparatus according to the present invention. The same elements as those shown in FIG. 1 are provided with the same reference numerals and explanation thereof will be omitted.

In this embodiment, the following elements are newly added to the first embodiment: pitch extracting means 33 for extracting a pitch period, pitch coding means for coding an extracted pitch period, pulse random codebooks 35, 37, and pitch decoding means 38.

The operation of this embodiment will now be explained with priority given to the newly added elements.

In the coding portion 1, the pitch extracting means 33 extracts the pitch period of the input speech 5 by a known method and outputs the extracted pitch period to the pitch coding means 34. The pitch coding means 34 quantizes the pitch period and outputs the corresponding code to the multiplexing means 3 and the quantized pitch period to the pulse random codebook 35.

Figure 3:
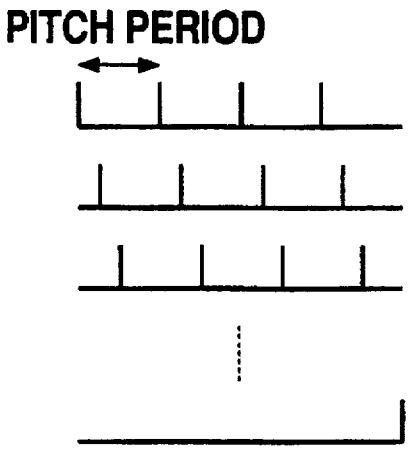
FIG. 3 shows an example of excitation vectors consisting of a pulse train having a pitch period in accordance with the present invention.
Figure 4:
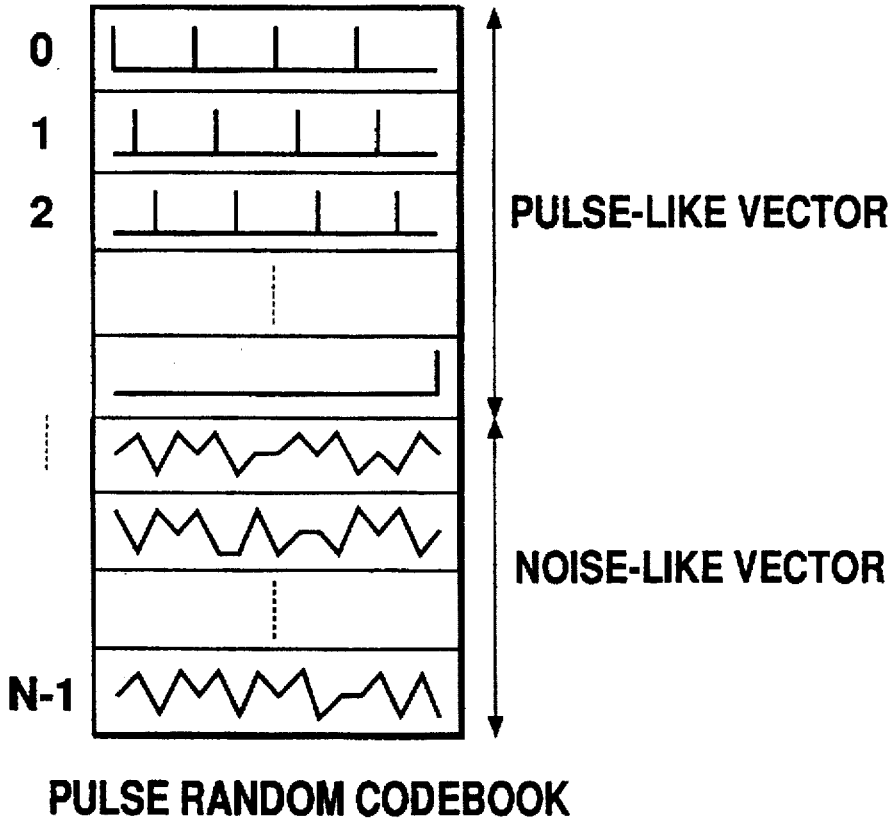
FIG. 4 shows an example of the excitation vectors stored in a pulse random codebook in accordance with the present invention.

The pulse random codebook 35 generates a plurality of excitation vectors consisting of a pulse train of the quantized pitch period in which, for example, the positions of the head pulses are different, and stores them as at least a part of the random vectors in the codebook 35. FIG. 3 shows an example of the excitation vector consisting of a pulse train of the pitch period, and FIG. 4 shows an example of the excitation vectors stored in the pulse random codebook 35. And the pulse random codebook 35 outputs the random vector which corresponds to the random code I input from the optimum code searching means 12.

The phase amplitude characteristic adding filter 30 adds the phase amplitude characteristic obtained using the quantized filter coefficient input from the phase amplitude characteristic coding means 29 to the excitation signal which is obtained by multiplying the adaptive vector which is output from the adaptive codebook 10 by the excitation gain β and multiplying the random vector which is output from the pulse random codebook 35 by the excitation gain γ, and adding the products, and outputs the thus-obtained excitation signal to the synthesis filter 9. The synthesis filter 9 generates synthesized speech by using the quantized linear prediction parameter which is input from the linear prediction parameter coding means 8 and the excitation signal with the phase amplitude characteristic added thereto.

The optimum code searching means 12 evaluates the perceptual weighted distortion of a residual signal between the synthesized speech and the input speech 5, obtains the adaptive code L, the random code I and the excitation gains β and γ which minimize the distortion, and outputs the adaptive code L and the random code I to the multiplexing means 3 and the excitation gains β and γ to the excitation gain coding means 13. The excitation gain coding means 13 quantizes the excitation gains β and γ and outputs those codes to the multiplexing means 3.

On the basis of these results, the multiplexing means 3 supplies the code which corresponds to the quantized linear prediction parameter, the code which corresponds to the quantized filter coefficient of the phase amplitude characteristic adding filter 30 and the codes which correspond to the adaptive code L, the quantized pitch period, the random code I and the excitation gains β and γ to a transmission path.

The schematic structure of the coding portion 1 of the second embodiment of the speech coding and decoding apparatus has been described above.

The operation of the decoding portion 2 will now be explained.

The separating means 4 which receives the outputs from the multiplexing means 3 separates the outputs and transmits the supplied adaptive code L to the adaptive codebook 14, the code of the pitch period to the pitch decoding means 36, the random code I to the random codebook 37, the codes of the excitation gains β and γ to the excitation gain decoding means 16, the code of the filter coefficient of the phase amplitude characteristic adding filter 30 to the phase amplitude characteristic decoding means 31, and the code of the linear prediction parameter to the linear prediction parameter decoding means 17.

The pitch decoding means 36 decodes the pitch period which corresponds to the code of the pitch period and outputs the decoded pitch period to the pulse random codebook 37. The pulse random codebook 37 stores the excitation vector consisting of a pulse train of the decoded pitch period in the codebook 37 in the same way as the random codebook The pulse random codebook 37 outputs the random vector which corresponds to the random code I.

The phase amplitude characteristic adding filter 32 adds the phase amplitude characteristic by using the filter coefficient input from the phase amplitude characteristic decoding means 31 to the excitation signal which is obtained by multiplying the adaptive vector which is output from the adaptive codebook 14 by the excitation gain β and multiplying the random vector which is output from the pulse random codebook 37 by the excitation gain γ, and adding the products, and outputs the thus-obtained excitation signal to the synthesis filter 18. The synthesis filter 18 outputs an output speech 8 by using the linear prediction parameter which is input from the linear prediction parameter decoding means 17 and the excitation signal with the phase amplitude characteristic added thereto.

As has been described above, according to the second embodiment, a pulse train of a pitch period is used for a random vector, and a phase amplitude characteristic is added to the random vector. In this manner, it is possible to generate an appropriate excitation signal from only a random vector. Consequently, even if an adaptive vector does not work, it is possible to produce an excitation signal with good reproducibility and to improve the quality of synthesized speech.

In this embodiment, the pulse train may be obtained from an adaptive code. In this case, the pitch extracting means 33, the pitch coding means 34 and the pitch decoding means in FIG. 2 are eliminated, and the pulse interval of the pulse train which is used as a random vector is obtained from the adaptive code. At this time, since it is not necessary to transmit the information of the pitch period with respect to the pulse interval, it is possible to reduce the amount of information transmitted. In addition, since the reproducibility of an excitation signal is good even if the adaptive vector does not work, it is possible to improve the quality of synthesized speech.

Third Embodiment

An embodiment of a phase amplitude characteristic extracting apparatus for extracting the short-term phase amplitude characteristic of a signal according to the present invention will be explained with reference to the accompanying drawings.

Figure 5:
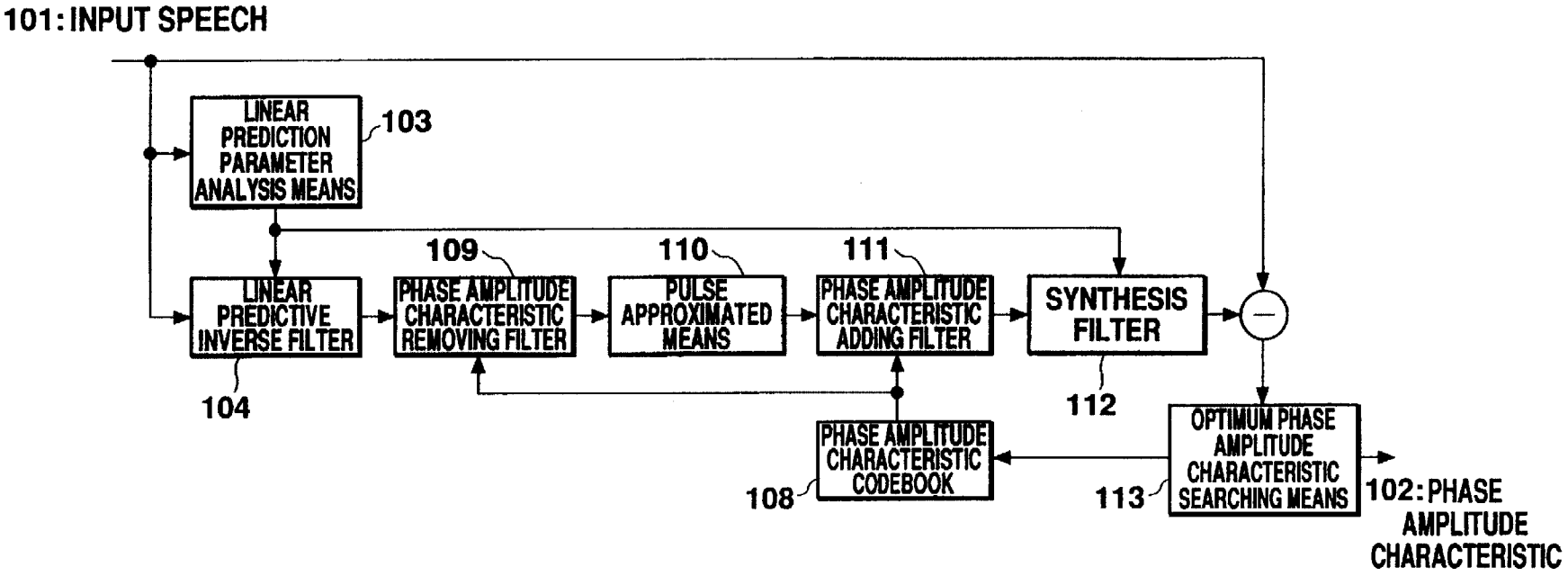
FIG. 5 is a block diagram of the structure of an apparatus for obtaining a short-term phase amplitude characteristic in a third embodiment of the present invention.

FIG. 5 is a block diagram of the structure of an apparatus for obtaining a phase amplitude characteristic. This apparatus is used to obtain the short-term phase amplitude characteristic of a linear prediction residual signal.

Figure 9:
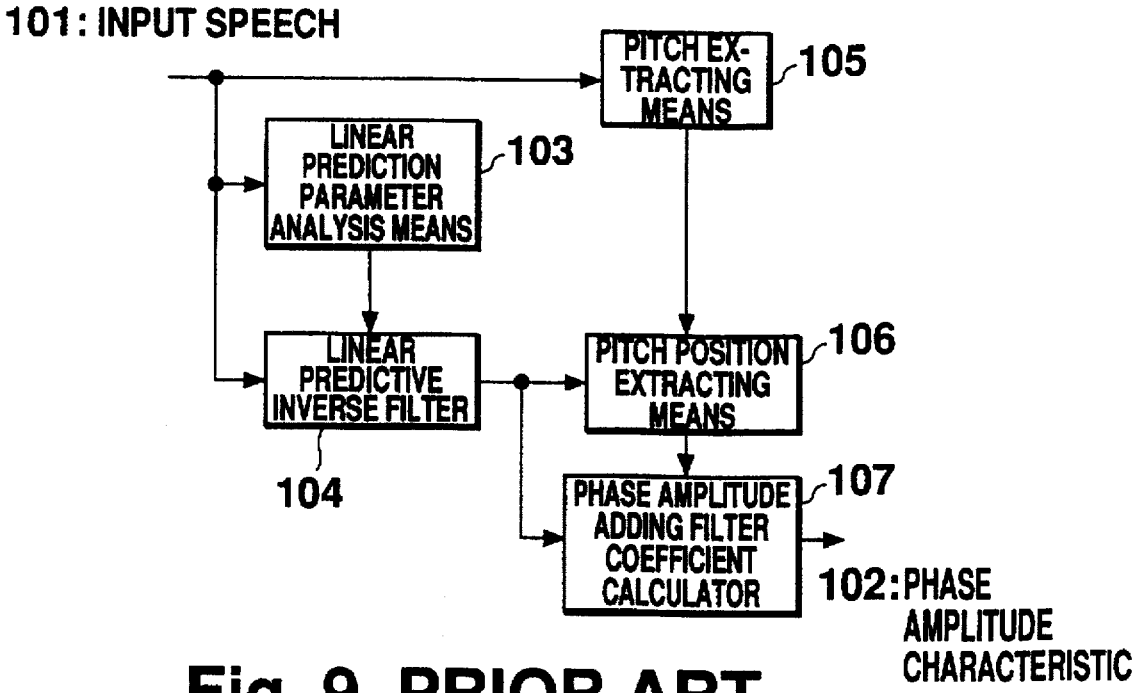
Fig. 9 PRIOR ART
FIG. 9 is a block diagram of a conventional apparatus for obtaining a short-term phase amplitude characteristic of an excitation signal.
Figure 10:
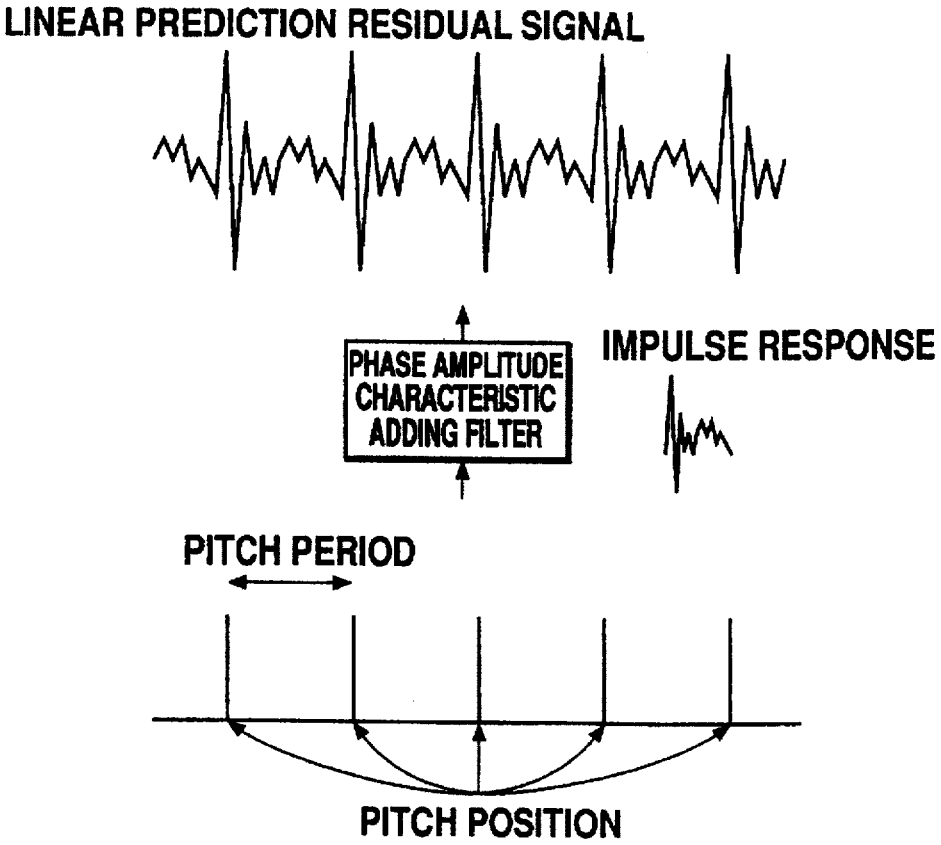
Fig. 10 PRIOR ART
FIG. 10 is an explanatory view of a change in the wave form due to a phase amplitude characteristic adding filter.

The following elements are newly added to the conventional apparatus shown in FIG. 9: a phase amplitude characteristic codebook 108, a phase amplitude characteristic removing filter 109 for removing the characteristic of a phase amplitude, pulse approximate means 110 for approximating or representing a residual signal by some pulses, a phase amplitude characteristic adding filter 111 for adding the characteristic of a phase amplitude, a synthesis filter 112 for synthesizing a speech form a linear prediction parameter and an excitation signal, and optimum phase amplitude characteristic searching means 113 for searching an optimum phase amplitude characteristic.

The operation of the apparatus will be explained with priority given to the characteristic structure thereof.

The linear prediction parameter analysis means 103 analyzes input speech 101 so as to extract the linear prediction parameter and outputs the extracted linear prediction parameter to the linear predictive inverse filter 104 and the synthesis filter 112. The linear predictive inverse filter 104 generates a linear prediction residual signal from the input speech 101 by using the linear prediction parameter, and outputs the linear prediction residual signal to the phase amplitude characteristic removing filter 109.

A plurality of phase amplitude characteristics are stored in the phase amplitude characteristic codebook as, for example, filter coefficients, and the phase amplitude characteristic codebook outputs the filter coefficient of the phase amplitude characteristic which corresponds to the code input from the optimum phase amplitude characteristic searching means 113 to the phase amplitude characteristic removing filter 109 and the phase amplitude characteristic adding filter 111. The phase amplitude characteristic removing filter 109 generates a residual signal by removing the phase amplitude characteristic from the linear prediction parameter signal by using the filter coefficient, and outputs the residual signal to the pulse approximate means 110. The pulse approximate means 110 generates a pulse signal representation residual signal by reducing the residual signal to zero except for N samples having the largest amplitude, for example, and outputs the pulse signal representation residual signal to the phase amplitude characteristic adding filter 111.

Figure 6:
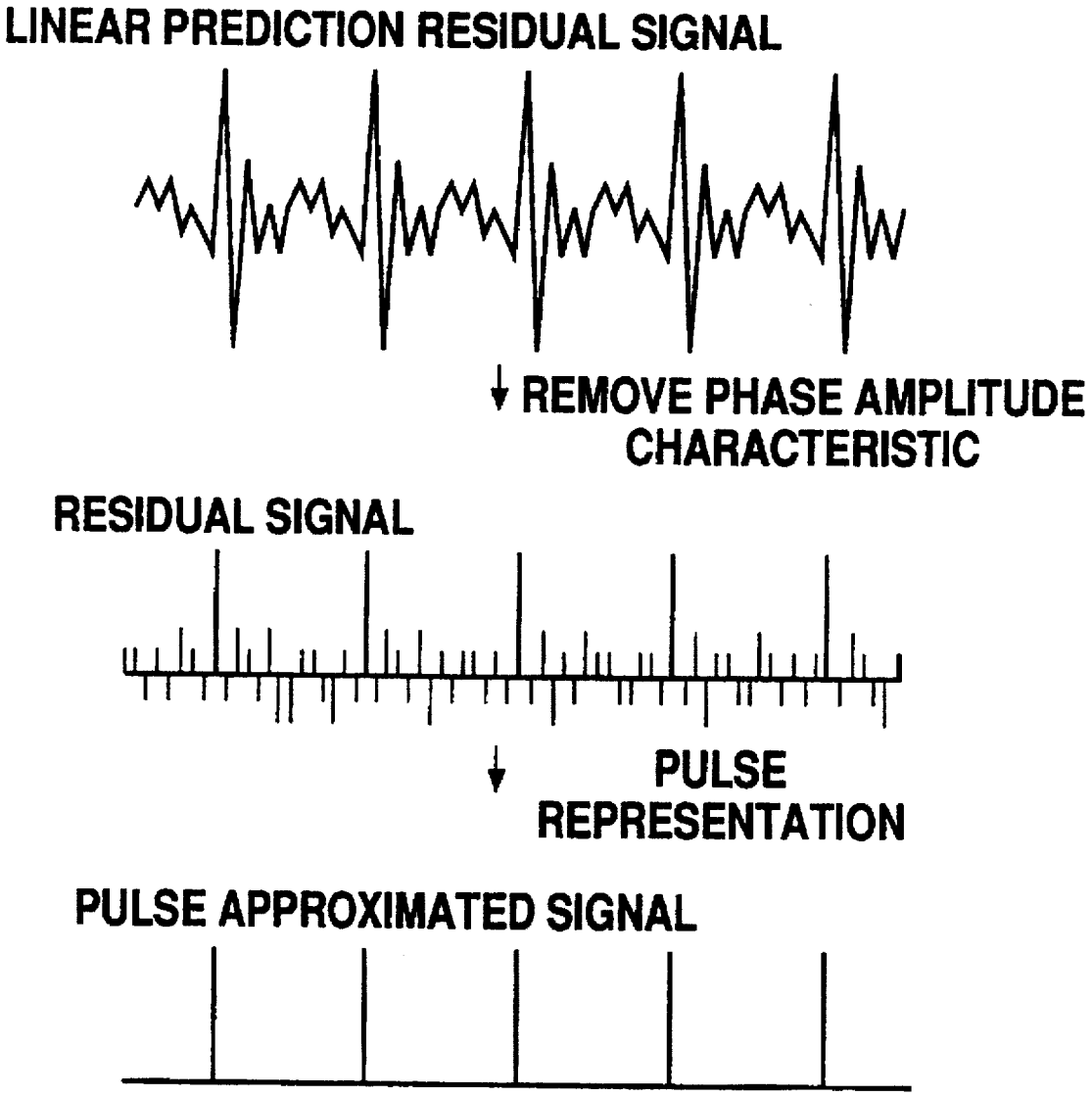
FIG. 6 shows the wave forms explaining an example of the generation of a pulse approximated signal in the present invention.

FIG. 6 shows an example of representation. FIG. 6 shows the process of generating a residual signal from a linear prediction residual signal by removing the phase amplitude characteristic, and then reducing the residual signal to a pulse so as to generate a pulse signal representation residual signal.

The phase amplitude characteristic adding filter 111 then adds the phase amplitude characteristic to the pulse signal representation residual signal by using the filter coefficient so as to produce an excitation signal and outputs the excitation signal to the synthesis filter 112. The synthesis filter 112 generates synthesized speech by using the linear prediction parameter and the excitation signal.

The optimum phase amplitude characteristic searching means 113 evaluates the perceptual weighted distortion of the residual signal between the synthesized speech and the input speech 101, selects the filter coefficient corresponding to the phase amplitude characteristic which minimizes the distortion from the phase amplitude characteristic codebook 108, and outputs the selected filter coefficient as the phase amplitude characteristic 102.

According to this embodiment, a codebook which stores a plurality of short-term phase amplitude characteristic of a signal is provided, a trial signal is generated by using each phase amplitude characteristic in the codebook and the phase amplitude characteristic which minimizes the distortion between an input signal and the trial signal is selected from the codebook. In this manner, it is possible to extract the phase amplitude characteristic without an error and without the need for pitch extraction or pitch position extraction when the short-term phase amplitude characteristic of a linear prediction residual signal of speech is obtained.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A speech coding apparatus comprising:

linear prediction parameter analysis means;

linear prediction parameter coding means;

excitation signal generating means;

a synthesis filter for synthesizing an output signal of said linear prediction parameter coding means and an excitation signal output from said excitation signal generating means;

phase amplitude characteristic coding means for quantizing and coding a short-term phase amplitude characteristic which is obtained by analyzing a linear prediction residual signal of input speech signal; and a phase amplitude characteristic adding filter for adding said short-term phase amplitude characteristic to said excitation signal.

2. A speech coding apparatus according to claim 1, wherein said excitation signal generating means includes:

an adaptive codebook for outputting an adaptive vector;

a random codebook for outputting a random vector; and an optimum code searching means for searching an optimum excitation; and uses a pulse train as said random vector.

3. A speech coding apparatus according to claim 2, wherein a pulse interval of said pulse train is obtained from an adaptive code.

4. A speech decoding apparatus comprising:

linear prediction parameter decoding means;

excitation signal generating means;

a synthesis filter for synthesizing an output signal of said linear prediction parameter decoding means and an excitation signal output from said excitation signal generating means;

phase amplitude characteristic decoding means for decoding a coded short-term phase amplitude characteristic; and a phase amplitude characteristic adding filter for adding the decoded short-term phase amplitude characteristic to said excitation signal.

5. A speech decoding apparatus according to claim 4, wherein said excitation signal generating means includes:

an adaptive codebook for outputting an adaptive vector;

a random codebook for outputting a random vector; and excitation gain decoding means;

and uses a pulse train as said random vector.

6. A speech decoding apparatus according to claim 5, wherein a pulse interval of said pulse train is obtained from an adaptive code.

7. A speech coding and decoding method comprising a coding process and a decoding process:

said coding process including the steps of:

coding a linear prediction parameter by linear prediction analysis of an input speech signal;

quantizing and coding a short-term phase amplitude characteristic which is obtained by analyzing a linear prediction residual signal of an input speech signal;

selecting an excitation signal for generating optimal synthesized speech from an excitation codebook;

adding said short-term phase amplitude characteristic to said excitation signal; and coding and transmitting said excitation signal; and said decoding process including the steps of:

generating an excitation signal and a decoded linear prediction parameter signal on the basis of a received signal;

decoding the coded phase amplitude characteristic;

adding the decoded phase amplitude characteristic to said excitation signal; and synthesizing said excitation signal and said decoded linear prediction parameter signal by a synthesis filter so as to generate an output speech signal.

8. A phase amplitude characteristic extracting apparatus for extracting a short-term phase amplitude characteristic of a signal, comprising:

a phase amplitude characteristic codebook which stores a plurality of short-term phase amplitude characteristics of a signal;

a phase amplitude characteristic removing filter for removing a phase amplitude characteristic;

residual signal generating means for generating a residual signal by removing a phase amplitude characteristic stored in said phase amplitude characteristic codebook from an input signal by said phase amplitude characteristic removing filter;

pulse approximated signal generating means for generating a pulse signal representation signal by reducing said residual signal to a small number of pulses;

trial signal generating means for generating a trial signal by adding each phase amplitude characteristic removed by said phase amplitude characteristic removing filter to said pulse signal representation signal; and selecting and outputting means for selecting a phase amplitude characteristic which minimizes a distortion between said trial signal and said input signal, from said phase amplitude characteristic codebook and outputting the selected phase amplitude characteristic.

* * * * *

UNITED STATES PATENT AND TRADEMARK OFFICE

CERTIFICATE OF CORRECTION

PATENT NO. : 5,724,480

DATED : March 3, 1998

INVENTOR(S) : Tadashi Yamaura

It is certified that error appears in the above-indentified patent and that said Letters Patent is hereby corrected as shown below:

In Fig. 1, Block 17, add the word "LINEAR" before -- PREDICTION PARAMETER DECODING MEANS --.

In Fig. 2, Block 17, add the word "LINEAR" before -- PREDICTION PARAMETER DECODING MEANS --.

In Fig. 7, Block 17, add the word "LINEAR" before -- PREDICTION PARAMETER DECODING MEANS --.

Figure 8:
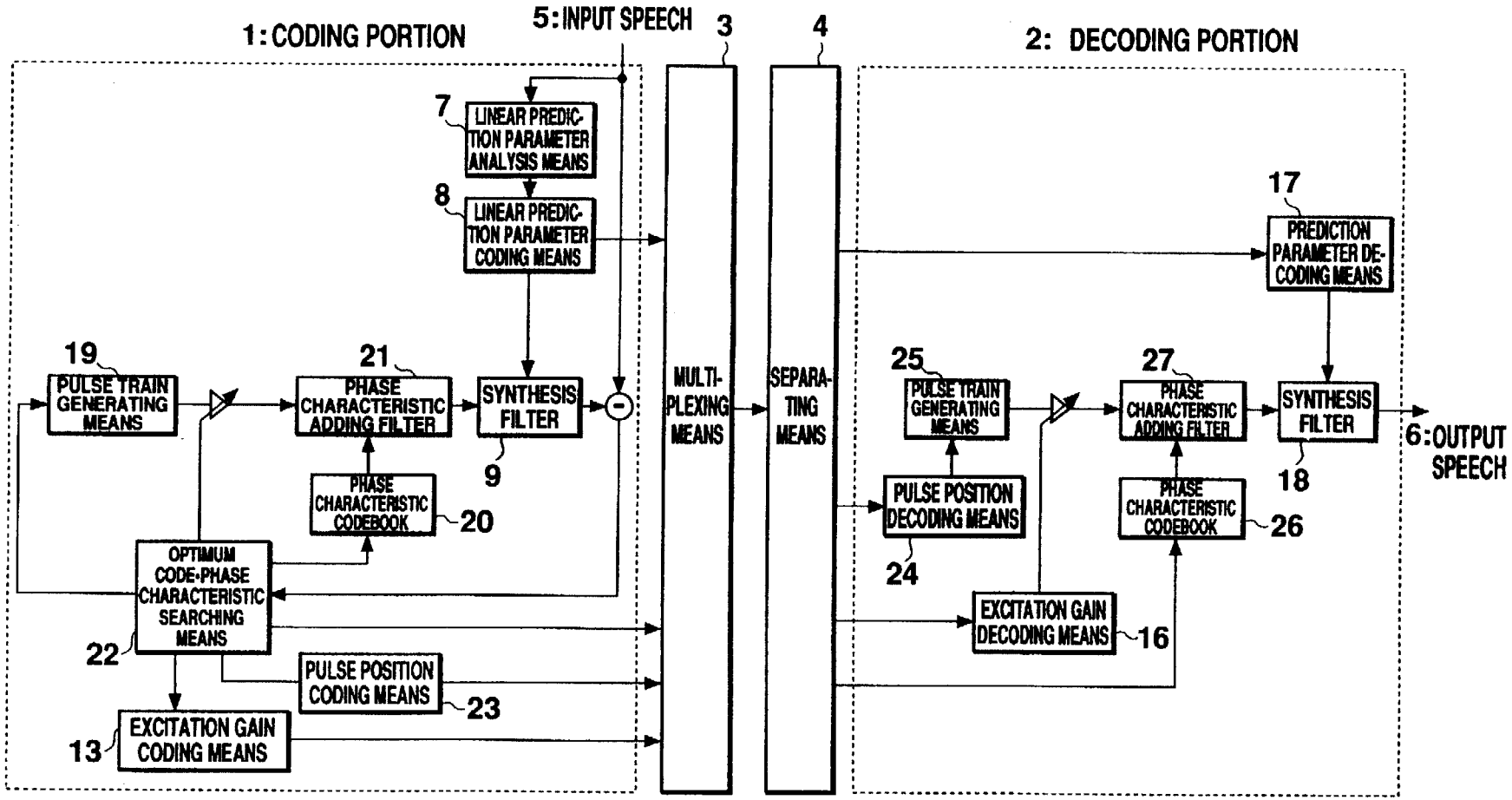
Fig. 8 PRIOR ART
FIG. 8 is a block diagram of the overall structure of an example of a conventional coding and decoding apparatus for coding the phase characteristic of an excitation signal.

In Fig. 8, Block 17, add the word "LINEAR" before -- PREDICTION PARAMETER DECODING MEANS --.

In Fig. 8, Block 22, change "OPTIMUM CODE-PHASE CHARACTERISTIC SEARCHING MEANS" to read -- OPTIMUM CODE SEARCHING MEANS --.

In column 1, line 13 change "code-driving" to read -- code-excited --.

In column 1, line 61 change "residual" to -- error --.

In column 2, line 14 change "$\gamma$ and $\beta$" to -- $\beta$ and $\gamma$--.

In column 2, line 22 change "$\gamma$ and $\beta$" to -- $\beta$ and $\gamma$--.

In column 2, line 57 change "excitation-phase characteristic" to -- code --.

In column 2, line 64 change "excitation-phase characteristic" to -- code --.

In column 3, line 25 change "excitation-phase characteristic" to -- code --.

UNITED STATES PATENT AND TRADEMARK OFFICE

CERTIFICATE OF CORRECTION

PATENT NO. : 5,724,480

DATED : March 3, 1998

INVENTOR(S) : Tadashi Yamaura

It is certified that error appears in the above-indentified patent and that said Letters Patent is hereby corrected as shown below:

In column 3, line 29 change "residual" to -- error --.

In column 3, line 52 change "28" to -- 26 --.

In column 3, line 65 change "18" to -- 16 --.

In column 4, line 8 change "1B" to -- 18 --.

In column 8, line 6 change "80" to -- 30 --.

In column 8, line 38 change "residual" to -- error --.

In column 8, line 65 change "18" to -- 16 --.

In column 9, line 13 change "18" to -- 16 --.

In column 9, line 16 change "18" to -- 16 --.

In column 9, line 45 after "means" insert -- 34 --.

In column 9, line 47 change "38" to -- 36 --.

In column 10, line 16 change "residual" to --error--.

In column 10, line 42 change "the random codebook 37" to -- a pulse random codebook 37 --.

In column 10, line 55 change "the random codebook 35" to -- a pulse random codebook 35 --.

UNITED STATES PATENT AND TRADEMARK OFFICE

CERTIFICATE OF CORRECTION

PATENT NO. : 5,724,480

DATED : March 3, 1998

INVENTOR(S) : Tadashi Yamaura

It is certified that error appears in the above-indentified patent and that said Letters Patent is hereby corrected as shown below:

In column 10, line 67 change "8" to -- 6 --.

In column 11, line 41 before "pulse" insert -- a --.

In column 12, line 3 change "parameter" to -- residual --.

In column 12, line 27 change "residual" to -- error --.

Signed and Sealed this

FourthDay of August, 1998

Bruce Lehman

*Attest:*

BRUCE LEHMAN

*Attesting Officer*

*Commissioner of Patents and Trademarks*